US006416214B2

(12) United States Patent
Forslund et al.

(10) Patent No.: US 6,416,214 B2
(45) **Date of Patent: *Jul. 9, 2002**

(54) MIXING DEVICE

(75) Inventors: Kjell Forslund, Sundsbruk; Magnus Danielsson; Tomas Wikström, both of Sundsvall, all of (SE)

(73) Assignee: Valmet Fibertech Aktiebolag (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/202,760

(22) PCT Filed: May 29, 1997

(86) PCT No.: PCT/SE97/00918

§ 371 (c)(1),
(2), (4) Date: Dec. 21, 1998

(87) PCT Pub. No.: WO97/49482

PCT Pub. Date: Dec. 31, 1997

(30) Foreign Application Priority Data

Jun. 26, 1996 (SE) ..... 9602543

(51) Int. Cl.[7] ..... B01F 15/00

(52) U.S. Cl. ..... 366/163.2; 366/167.1; 261/76

(58) Field of Search ..... 366/167.1, 176.1, 366/176.2, 176.4, 163.2, 165.5, 173.1, 173.2, 178.1, 178.2, 178.3, 182.4; 261/78, DIG. 75, DIG. 76

(56) References Cited

U.S. PATENT DOCUMENTS 344,480 A * 6/1886 Holden et al.
1,982,479 A * 11/1934 Ober et al. ..... 366/178.1
3,031,127 A * 4/1962 Duhaime et al.
3,200,764 A * 8/1965 Saunders, Jr.
3,542,342 A * 11/1970 Barron ..... 366/167.1
3,942,724 A * 3/1976 Mocarski
4,344,752 A * 8/1982 Gallagher, Jr. ..... 366/167.1
4,625,916 A * 12/1986 Nieuwkamp et al. ..... 366/178
4,634,560 A * 1/1987 Eckert
4,689,237 A * 8/1987 Fabre ..... 261/76
5,131,757 A * 7/1992 Smith ..... 366/173.2
5,338,113 A * 8/1994 Fissenko ..... 366/178.2
5,366,288 A 11/1994 Dahllöf et al. ..... 366/176
5,445,226 A * 8/1995 Scott et al. ..... 366/340
5,445,801 A * 8/1995 Pisoni ..... 261/112.1

FOREIGN PATENT DOCUMENTS

SE 9400387-8 2/1994
SE 500 072 4/1994

OTHER PUBLICATIONS

Kvaerner Pulping, MPC™Mixer, High Quality Mixing, Low Cost Operation, Aug. 1995.

Kvaerner MC® Mixer, Efficient Mixing of Chemicals Into Pulp at Medium Consistency, Sep. 1995.

* cited by examiner

*Primary Examiner*—Tony G. Soohoo
(74) *Attorney, Agent, or Firm*—Lerner, David, Littenberg, Krumholz & Mentlik, LLP

(57) ABSTRACT

Apparatus for mixing steam or bleaching agents with a pulp suspension is disclosed, including a chamber for receiving the flow of pulp suspension from an input line, the chamber including a jacket surrounding the flow of pulp suspension through the chamber, the inlet to the chamber defined by an inlet flange having a diameter which is smaller than the diameter of the input line, and the jacket including a supply orifice for supplying the steam or bleaching fluid to the flow of pulp suspension in the chamber.

22 Claims, 2 Drawing Sheets

MIXING DEVICE

FIELD OF THE INVENTION

The present invention relates to a device for admixing an agent in the form of a gas or liquid into a material flow. More particularly, the present invention relates to such a device comprising a chamber, through which the material flow is intended to pass, and means for the supply of gas/liquid to the chamber. More particularly, the present invention relates to such a device intended especially for admixing a gas, such as steam or a bleach gas, into a pulp suspension.

BACKGROUND OF THE INVENTION

During the treatment of pulp suspensions, various processing agents need to be admixed thereinto, such as for heating or bleaching purposes. It is desired in this connection to atomize the agents in the pulp while the pulp is being transported. For heating the pulp, steam is generally supplied, which condenses and thereby delivers its heat content to the pulp. During bleaching, bleaching agents are added to react with the pulp. In connection with the treatment of recycled fiber pulp, black ink is separated by flotation, implying that air is to be atomized into the pulp.

In all of these cases, it is difficult to achieve uniform admixing. During the heating of pulp by steam supplied to a pulp line, problems are often caused by the formation of large steam bubbles on the inside of the line. When these bubbles rapidly condense, they give rise to condensate bangs, which cause detrimental cavitations in the line and subsequent equipment. It is also difficult to achieve an entirely uniform temperature profile in the pulp. This can be cured by inserting steam supply lines into the pulp line, but this reduces the flow in the line.

For a more uniform admixture of the agent, the material flow can be divided into narrow gaps where the processing agent is supplied. This, however, restricts the capacity and creates a greater risk of clogging. Problems also arise when the material after its passage through the gaps, is again united into a single flow.

The present invention has an object to eliminate the aforesaid problems.

SUMMARY OF THE INVENTION

In accordance with the present invention, this and other objects have now been realized by the invention of apparatus for admixing a fluid agent with a flow of material comprising a chamber including an inlet and an outlet, the inlet adapted for connection with an input line for the material having a first predetermined size, and the outlet adapted for connection with an output line for the admixture of the material with the fluid agent and having a second predetermined size, whereby the material can flow through the chamber from the inlet to the outlet, the chamber including a jacket surrounding the flow of the material through the chamber, the inlet defined by an inlet flange and the outlet defined by an outlet flange, the inlet flange defining an opening into the chamber having a third predetermined size smaller than the first predetermined size of the input line, and the jacket including supply means for supplying the fluid agent to the flow of material within the chamber. In a preferred embodiment, the jacket is cylindrical.

In accordance with one embodiment of the apparatus of the present invention, the fluid agent comprises a liquid or gas.

In accordance with another embodiment of the apparatus of the present invention, the material comprises a pulp suspension.

In accordance with one embodiment of the apparatus of the present invention, the jacket has a fourth predetermined size, and the third predetermined size of the inlet flange is smaller than the fourth predetermined size of the jacket.

In accordance with another embodiment of the apparatus of the present invention, the supply means comprises an adjustable gap formed by the jacket, whereby the supply of the fluid agent to the chamber can be controlled. Preferably, the adjustable gap is located at the inlet. In a preferred embodiment, the inlet flange extends into the chamber a predetermined distance to an inner surface of the inlet flange, and the adjustable gap is located immediately outside of the inner surface of the inlet flange whereby an ejector effect is obtained for the fluid agent.

In accordance with one embodiment of the apparatus of the present invention, the supply means comprises a plurality of perforations in the jacket.

In accordance with another embodiment of the apparatus of the present invention, the supply means comprises at least two insert pipes extending through the jacket.

In accordance with another embodiment of the apparatus of the present invention, the apparatus includes a housing enclosing the jacket, thereby defining a space between the housing and the jacket, and including a distributor for the fluid agent comprising the space between the housing and the jacket.

According to the present invention, the processing agent is supplied to a chamber with a cylindrical jacket, through which the material flow passes.

According to the present invention, the material flow passing through the chamber is supplied through an ingoing line and removed through an outgoing line. Due to the reduction in area from the ingoing line to the chamber, according to the present invention a deformation of the flow field of the material flow takes place at the entrance to the chamber. The reduction in area should be from about 10 to 90%, and preferably from about 40 to 60%. This gives rise to shear stresses in the material which have a certain short duration. By utilizing this condition of the material for the admixture of the agent, uniform mixing of atomized agent in the material is obtained.

BRIEF DESCRIPTION OF THE DRAWINGS

The present invention is described in grater detail in the following detailed description which, in turn, refers to the accompanying drawings illustrating some embodiments of the present invention, wherein.

DETAILED DESCRIPTION

Figure 1:
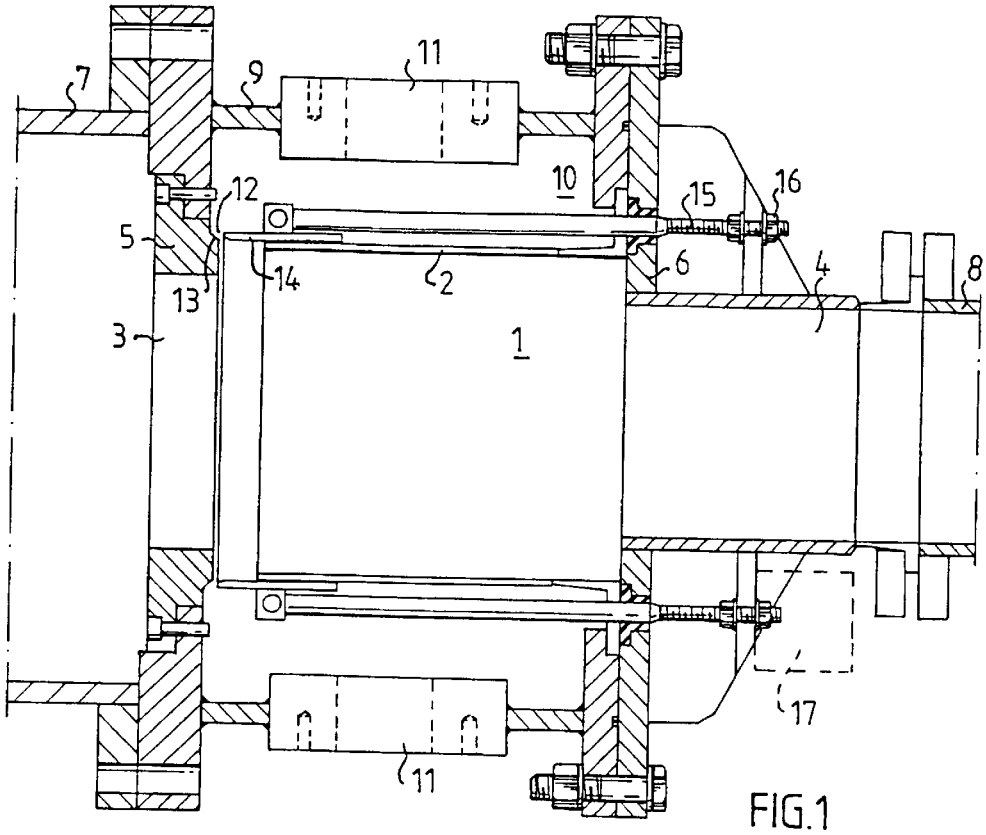
FIG. 1 is a side, elevational, sectional view of apparatus in accordance with the present invention.

Referring to the Figures, in which like reference numerals refer to like elements thereof, the device according to FIG. 1 consists of a chamber 1, which is outwardly defined by a cylindrical jacket 2. The inlet 3 and the outlet 4, respectively, of the chamber 1 are provided with flanges 5 and 6. The diameters of the openings in the flanges, 5 and 6, are smaller than that of the chamber 1. The inlet flange 5 is preferably exchangeable to permit change of the inlet diameter. The opening of the outlet flange 6 should be equal to or smaller than that of the opening of the inlet flange 5.

The device is connected to an ingoing line 7 for the material flow, to which the agent is to be admixed. The inlet flange 5 has a diameter smaller than the diameter of the ingoing line 7. The outlet 4 of the chamber 1 is connected to an outgoing line 8 for the material flow with admixed agent.

The jacket 2 of the chamber 1 is enclosed in a housing 9 whereby an overall space 10 for atomizing the agent is formed between the jacket 2 and the housing 9. The agent is supplied to the space 10 through connections 11, and preferably several such connections 11 are distributed about the housing 9. The lowest located connection 11 can be used alternatively for condensate and draining. The space 10 communicates with the chamber 1 by means of an overall adjustable gap 12, through which the agent is supplied. The gap 12 is defined by a seat 13 on the inlet flange 5 and an axially movable ring 14. The ring 14 is guided on the jacket 2 and by means of set screws 15 can be adjusted by nuts 16 or setting means 17 for adjusting the gap 12. By using setting means 17, the setting of the gap can be coupled to the control of the agent supply. The gap can thereby be closed at the same time as the agent supply is cut off, so that the material does not penetrate out into the space 10.

By the reduction in area from the ingoing line 7 to the inlet flange 5, the condition in the material flow which is favorable for the admixing, as described above, is obtained. This effect is additionally increased at the outlet 4, because the area reduction from the chamber 1 to the outlet flange 6 creates the same phenomenon.

Figure 2:
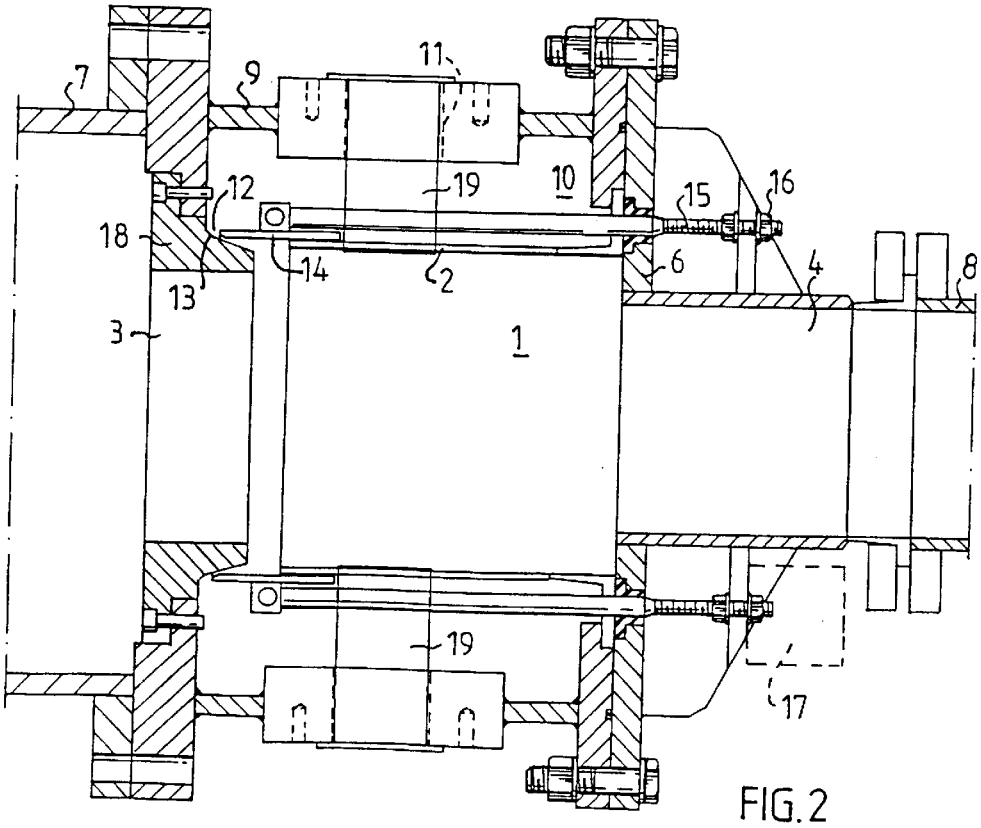
FIG. 2 is a side, elevational, sectional view of another embodiment of apparatus according to the present invention.

The embodiment of the present invention shown in FIG. 2 corresponds substantially to that shown in FIG. 1. The inlet flange 18, however, in this case is modified so as to extend into the chamber 1, and the gap 12 is located outside the inlet flange 18. This creates an ejector effect for ingoing agent, which can still promote more uniform admixing.

Two insert pipes 19 for agent supply are connected to the jacket 2 of the chamber 1. By this arrangement, a still more effective penetration of the agent into the material flow is obtained. It can be advantageous to use this embodiment especially in connection with steam supply for heating the material. This applies especially when the desired increase in temperature is great, such as from about 20 to 25° C.

Figure 3:
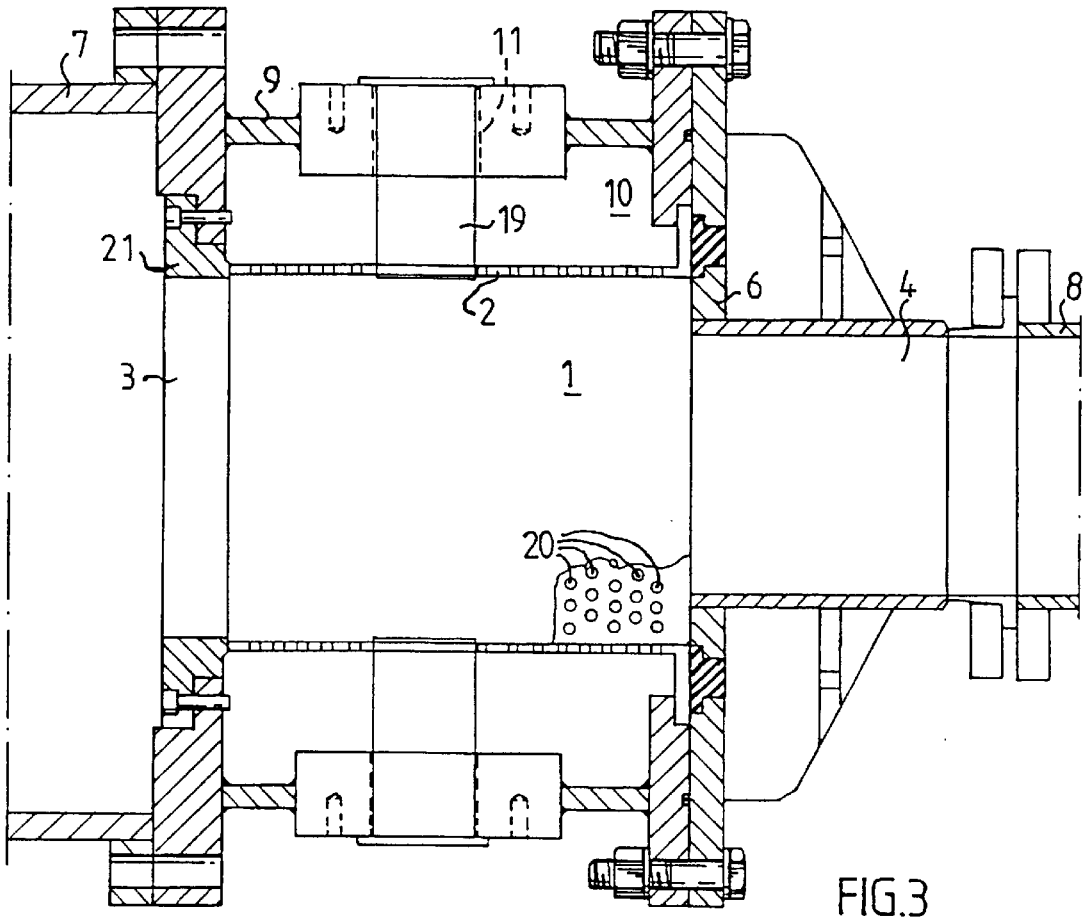
FIG. 3 is a side, elevational, partial sectional view of another embodiment of apparatus according to the present invention.
Figure 4:
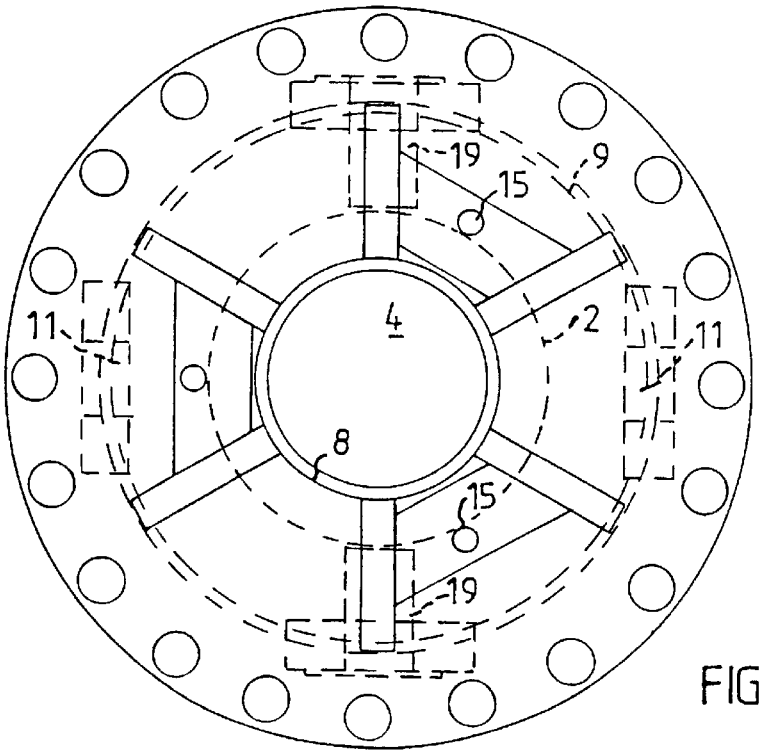
FIG. 4 is a front, elevational view of the apparatus shown in FIG. 2.

A further embodiment of the present invention is shown in FIG. 3 where the jacket 2 of the chamber 1 is provided with perforations 20 for the supply of agent. These perforations replace the gap in the above embodiments. The diameter of the opening in the inlet flange 21 is in this case equal to that of the chamber, while the diameter of the opening in the outlet flange 6 is smaller than that of the chamber as shown in earlier embodiments. As with the embodiment according to FIG. 2, insert pipes 19 are inserted through the jacket 2 of the chamber to improve the penetration of the agent.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for admixing a fluid agent with a flow of material comprising a jacket defining a chamber, said chamber having a first and second end; an inlet flange adjacent said first end of said chamber, said inlet flange defining an inlet in fluid connection with said first end of said chamber; an outlet flange adjacent said second end of said chamber, said outlet flange defining an outlet in fluid connection with said second end of said chamber; an input line having a first predetermined size adapted for connection to said inlet flange; said outlet having a second predetermined size, said inlet having a third predetermined size, and said jacket having a fourth predetermined size measured at the broadest section of said jacket, wherein said third predetermined size of said inlet is smaller than said first predetermined size of said input line and said fourth predetermined size of said chamber, and said second predetermined size of said outlet is smaller than said fourth predetermined size of said chamber; said jacket including supply means for supplying said fluid agent into said chamber for admixing with said material within said chamber; and a housing surrounding said jacket forming an annular space therebetween.

2. The apparatus of claim 1 wherein said jacket is cylindrical.

3. The apparatus of claim 1 wherein said fluid agent comprises a liquid or gas.

4. The apparatus of claim 1 wherein said material comprises a pulp suspension.

5. The apparatus of claim 1 wherein said supply means comprises at least two insert pipes extending through said jacket.

6. The apparatus of claim 1 including a housing enclosing said jacket, thereby defining a space between said housing and said jacket, and including a distributor for said fluid agent comprising said space between said housing and said jacket.

7. The apparatus of claim 1 wherein said chamber is unobstructed between locations adjacent said first and second ends.

8. The apparatus of claim 1 wherein said inlet flange is adjacent said first end of said chamber.

9. The apparatus of claim 1 wherein said chamber includes sidewalls of uniform diameter.

10. The apparatus of claim 1 wherein said second predetermined size of said outlet is smaller than or equal to said third predetermined size of said inlet.

11. The apparatus of claim 1 wherein said outlet flange is adjacent said second end of said chamber.

12. Apparatus for admixing a fluid agent with a flow of material comprising a jacket defining a chamber, said chamber having a first and second end; an inlet flange adjacent said first end of said chamber, said inlet flange defining an inlet in fluid connection with said first said end of said chamber; an outlet flange adjacent said second end of said chamber, said outlet flange defining an outlet in fluid connection with said second end of said chamber; an inlet line having a first predetermined size adapted for connection to said inlet flange, said outlet having a second predetermined size, said inlet having a third predetermined size, and said jacket having a fourth predetermined size measured at the broadest section of said jacket, wherein said third predetermined size of said inlet is smaller than said first predetermined size of said input line and said fourth predetermined size of said jacket, and said second predetermined size of said outlet is smaller than said fourth predetermined size of said jacket; said jacket including supply means for supplying said fluid agent into said chamber for mixing with said material within said chamber, wherein said supply means comprises an adjustable gap formed by said jacket, whereby the supply of said fluid agent to said chamber can be controlled; and a housing surrounding said jacket forming an annular space therebetween.

13. The apparatus of claim 12 wherein said adjustable gap is located at said inlet.

14. The apparatus of claim 13 wherein said inlet flange extends into said chamber a predetermined distance to an inner surface of said inlet flange, and said adjustable gap is located immediately outside of said inner surface of said inlet flange whereby an ejector effect is obtained for said fluid agent.

15. The apparatus of claim 12 wherein said supply means comprises a plurality of perforations in said jacket.

16. The apparatus of claim 12 wherein said chamber includes sidewalls of uniform diameter.

17. Apparatus for admixing a fluid agent with a flow of material comprising a jacket defining a cylindrical chamber, said chamber having a first and second end; an inlet flange adjacent said first end of said cylindrical chamber, said inlet flange defining an inlet smaller than said inlet flange in fluid connection with said first end of said cylindrical chamber; an outlet flange adjacent said second end of said chamber, said outlet flange defining an outlet smaller than said outlet flange in fluid connection with said second end of said chamber; an input line having a first predetermined size adapted for connection to said inlet flange, said outlet having a second predetermined size, said inlet having a third predetermined size, and said cylindrical chamber having a fourth predetermined size, wherein said third predetermined size of said inlet is smaller than said first predetermined size of said input line and said fourth predetermined size of said cylindrical chamber, and said second predetermined size of said outlet is smaller than said fourth predetermined size of said cylindrical chamber; said jacket including supply means for supplying said fluid agent into said cylindrical chamber for admixing with said material within said cylindrical chamber; and a housing surrounding said jacket forming an annular space therebetween.

18. The apparatus of claim 17 wherein a portion of said inlet flange obstructs a portion of said first end of said cylindrical chamber and said outlet flange obstructs a portion of said second end of said cylindrical chamber.

19. The apparatus of claim 17 further including an outlet line attached to said outlet flange defining said outlet.

20. Apparatus for admixing a fluid agent with a flow of material comprising a jacket defining a chamber, said chamber having a first and second end; an inlet flange adjacent said first end of said chamber, said inlet flange defining an inlet in fluid connection with said first said end of said chamber; an outlet flange adjacent said second end of said chamber, said outlet flange defining an outlet in fluid connection with said second end of said chamber; an inlet line having a first predetermined size adapted for connection to said inlet flange, said outlet having a second predetermined size, said inlet having a third predetermined size, and said jacket having a fourth predetermined size measured at the broadest section of said jacket, wherein said third predetermined size of said inlet is smaller than said first predetermined size of said input line and said fourth predetermined size of said jacket, and said second predetermined size of said outlet is smaller than said fourth predetermined size of said jacket; said jacket including supply means for supplying said fluid agent into said chamber for mixing with said material within said chamber, wherein said supply means comprises an adjustable gap formed by said jacket, wherein said inlet flange extends into said chamber a predetermined distance to an inner surface of said inlet flange, and said adjustable gap is located at said inlet immediately outside of said inner surface of said inlet flange whereby an ejector effect is obtained for said fluid agent, whereby the supply of said fluid agent to said chamber can be controlled.

21. Apparatus for admixing a fluid agent with a flow of material comprising a jacket defining a chamber, said chamber having a first and second end; an inlet flange adjacent said first end of said chamber, said inlet flange defining an inlet in fluid connection with said first said end of said chamber; an outlet flange adjacent said second end of said chamber, said outlet flange defining an outlet in fluid connection with said second end of said chamber; an inlet line having a first predetermined size adapted for connection to said inlet flange, said outlet having a second predetermined size, said inlet having a third predetermined size, and said jacket having a fourth predetermined size measured at the broadest section of said jacket, wherein said third predetermined size of said inlet is smaller than said first predetermined size of said input line and said fourth predetermined size of said jacket, and said second predetermined size of said outlet is smaller than said fourth predetermined size of said jacket; said jacket including supply means for supplying said fluid agent into said chamber for mixing with said material within said chamber, wherein said supply means comprises a plurality of perforations in said jacket, whereby the supply of said fluid agent to said chamber can be controlled.

22. Apparatus for admixing a fluid agent with a flow of material comprising a jacket defining a chamber having sidewalls of uniform diameter, said chamber having a first and second end; an inlet flange adjacent said first end of said chamber, said inlet flange defining an inlet in fluid connection with said first said end of said chamber; an outlet flange adjacent said second end of said chamber, said outlet flange defining an outlet in fluid connection with said second end of said chamber; an inlet line having a first predetermined size adapted for connection to said inlet flange, said outlet having a second predetermined size, said inlet having a third predetermined size, and said jacket having a fourth predetermined size measured at the broadest section of said jacket, wherein said third predetermined size of said inlet is smaller than said first predetermined size of said input line and said fourth predetermined size of said jacket, and said second predetermined size of said outlet is smaller than said fourth predetermined size of said jacket; and said jacket including supply means for supplying said fluid agent into said chamber for mixing with said material within said chamber, wherein said supply means comprises an adjustable gap formed by said jacket, whereby the supply of said fluid agent to said chamber can be controlled.

* * * * *